US009486897B2

(12) United States Patent
Trotsky

(10) Patent No.: US 9,486,897 B2
(45) Date of Patent: Nov. 8, 2016

(54) FOLDABLE CLAMP FOR A MOUNTING SYSTEM

(71) Applicant: Kevin Trotsky, Denver, CO (US)

(72) Inventor: Kevin Trotsky, Denver, CO (US)

( * ) Notice: Subject to any disclaimer, the term of this patent is extended or adjusted under 35 U.S.C. 154(b) by 55 days.

(21) Appl. No.: 14/214,148

(22) Filed: Mar. 14, 2014

(65) Prior Publication Data

US 2014/0259568 A1 Sep. 18, 2014

Related U.S. Application Data

(63) Continuation-in-part of application No. 14/045,692, filed on Oct. 3, 2013.

(60) Provisional application No. 61/783,937, filed on Mar. 14, 2013.

(51) Int. Cl.

| | |
|---|---|
| ***B25B 5/06*** | (2006.01) |
| ***B25B 5/00*** | (2006.01) |
| ***B25B 5/16*** | (2006.01) |

(52) U.S. Cl.

CPC ..... *B25B 5/006* (2013.01); *B25B 5/068* (2013.01); *B25B 5/163* (2013.01); *B25B 5/166* (2013.01); *Y10T 24/44581* (2015.01)

(58) Field of Classification Search

CPC ..... B25B 5/068; B25B 5/102; B25B 5/16
USPC ..... 269/214
See application file for complete search history.

(56) References Cited

U.S. PATENT DOCUMENTS

| | | | | |
|---|---|---|---|---|
| 292,391 | A | 1/1884 | Weiser | |
| 881,530 | A | 3/1908 | Barker | |
| 934,676 | A | 9/1909 | Langslow | |
| 1,189,144 | A * | 6/1916 | Lippincott | B25B 5/068 269/214 |
| 2,487,997 | A * | 11/1949 | West | B25B 5/068 269/166 |
| 2,688,351 | A * | 9/1954 | Sweet | B25B 5/068 269/208 |
| 4,078,781 | A * | 3/1978 | Fraser | B25B 5/102 269/171 |
| 4,381,105 | A | 4/1983 | Goff et al. | |
| 4,678,153 | A | 7/1987 | Maddock et al. | |
| 4,846,431 | A * | 7/1989 | Pflieger | F16B 2/065 24/514 |
| 5,145,157 | A * | 9/1992 | Polk | B25B 1/2421 269/210 |
| 5,276,949 | A | 1/1994 | Cordellini | |
| 5,344,115 | A | 9/1994 | Mayne et al. | |
| 5,765,820 | A | 6/1998 | Marusiak | |
| 6,119,992 | A | 9/2000 | Stuart | |
| 6,929,253 | B2 * | 8/2005 | Marks | B25B 5/068 269/170 |
| 6,966,533 | B1 | 11/2005 | Kalis et al. | |
| 7,499,269 | B2 | 3/2009 | Allen | |

(Continued)

FOREIGN PATENT DOCUMENTS

WO WO 2012/016158 2/2012

OTHER PUBLICATIONS

U.S. Appl. No. 14/045,692, filed Oct. 3, 2013, Trotsky.

(Continued)

*Primary Examiner* — Cassandra Davis
(74) *Attorney, Agent, or Firm* — Sheridan Ross P.C.

(57) ABSTRACT

A foldable clamp suitable for use in a mounting system is disclosed. In one embodiment, the foldable clamp comprises a base member, a first jaw, and a second jaw. The first jaw is connected to the base member using a first hinge. The second jaw is connected to the base member using a second hinge and a ratchet. A mount for selective interconnection is provided on either the first jaw, the second jaw, or the third jaw.

20 Claims, 20 Drawing Sheets

(56) References Cited

U.S. PATENT DOCUMENTS

| | | | | |
|---|---|---|---|---|
| 7,669,816 | B2 | 3/2010 | Crain et al. | |
| 8,162,277 | B2 | 4/2012 | Russell | |
| 8,240,647 | B2 | 8/2012 | Geier et al. | |
| D673,528 | S | 1/2013 | Trotsky | |
| 2008/0029944 | A1* | 2/2008 | Avalani | B25B 5/16 269/6 |
| 2009/0122474 | A1 | 5/2009 | Mickey et al. | |
| 2011/0043990 | A1 | 2/2011 | Mickey et al. | |
| 2012/0025684 | A1 | 2/2012 | Trotsky | |
| 2012/0317776 | A1 | 12/2012 | Carnevali | |
| 2013/0026324 | A1 | 1/2013 | Fischer et al. | |
| 2013/0187020 | A1 | 7/2013 | Trotsky | |
| 2013/0206942 | A1 | 8/2013 | Trotsky | |

OTHER PUBLICATIONS

International Search Report for International (PCT) App. No. PCT/US14/29457, mailed Aug. 7, 2014, 9 pages.

Official Action for U.S. Appl. No. 14/045,692, mailed Feb. 3, 2016 20 pages.

International Preliminary Report on Patentability for International (PCT) Patent Application No. PCT/US2014/029457, mailed Sep. 24, 2015 8 pages.

* cited by examiner

FOLDABLE CLAMP FOR A MOUNTING SYSTEM

This application claims the benefit of U.S. Provisional Patent Application No. 61/783,937, filed Mar. 14, 2013, the entirety of which is incorporated by reference herein.

This application is a continuation-in-part of U.S. patent application Ser. No. 14/045,692, filed Oct. 3, 2013, the entirety of which is incorporated by reference herein.

FIELD OF THE INVENTION

Embodiments of the present invention generally relate to mounting systems and methods. Some embodiments of the present invention employ a clamp that can be used for selective interconnection to and support of a device, such as a light, a mobile phone, a tablet computer, camera, etc.

BACKGROUND OF THE INVENTION

It is often desirable to use an electronic device such as a light, a mobile phone, tablet computer, a camera, etc. in a "hands-free" mode. This is often accomplished by attaching the device to a table, a pole, etc. Examples might include: 1) attaching a global positioning systems (GPS) unit to a handle in a car; 2) attaching a tablet computer to a headboard of the bed so the tablet computer can be used in a hands-free manner; 3) attaching a lamp to a stage pole; and 4) attaching a tablet computer to a pole or table.

SUMMARY OF THE INVENTION

It is one aspect of embodiments of the present invention to provide a clamp for use with a device mounting and supporting system. The mounting and supporting system may be selectively adjustable to allow for the device to be positioned in several ways. In one embodiment, the clamp comprises a first jaw and a second jaw selectively interconnected to a rack of a ratcheting mechanism. Further, the first jaw may be hingedly interconnected to the rack. The second jaw is connected to the rack by way of a carrier that is slidingly associated with the rack. The lower jaw may be hingedly interconnected to the carrier. The carrier is also associated with a pawl that operatively engages rack teeth, i.e., gears, in a ratcheting fashion. The two jaws are configured to attach to flat objects such as table tops, round objects such as light poles, or objects of other geometric profiles and orientations A connector for selective interconnection to the device mount or support system may be provided on either the first jaw or the second jaw. Although shown extending from an upper surface of the upper jaw, the connector may be recessed within the upper jaw without departing from the scope of the invention. More specifically, the connector is adapted to interconnect to the supporting and mounting system that selectively accommodates an electronic device. The connector can be placed on any portion of the clamp, and not limited to the upper jaw. In some embodiments of the present invention the connector is placed on the side of the jaws. In other embodiments, the connector is operatively interconnected to a track such that the connector can be selectively moved to accommodate the user's desires. One of skill in the art will also appreciate that the clamp may provide multiple connectors to further expand the connection possibilities the clamp provides.

It is a related aspect of some embodiments of the present invention that the clamp can support the weight of various items. For example, one embodiment of the present invention includes a lower jaw having an outward extent that is positioned outward from an outward extent of the upper jaw. The extended lower jaw increases the force supported by the lower jaw which facilitates securing heavier objects. One of skill in the art will also appreciate that the lower jaw may also be expandable such that its outer extent can be further separated from the rack to support heavier loads.

Some embodiments of the present invention include an upper jaw having fingers. The fingers engage a surface and create frictional loads that help secure the clamp to an object. When the clamp is interconnected to a vertical surface or a tubular member, the fingers also help to react to loads. Fingers of some embodiments are selectively adjustable wherein the angle between the fingers may be expanded to spread out reactive loads or enhance frictional interactions. In some other embodiments, the fingers telescope outwardly such that the outer extent of the upper jaw is greater than the lower jaw, which facilitates interconnection of the clamp in an upside down configuration wherein the upper jaw is placed under a table, for example.

Still further, some embodiments of the present invention employ upper jaws and lower jaws that are spring-loaded or that employ a leaf spring such that when the upper jaw or lower jaw are engaged tightly onto surface, the activated spring firmly secure the jaws to the surface or object to which they are connected. Spring-loaded jaws also help seat the pawl into the rack.

It is also contemplated that the upper jaw and lower jaw are configured to interconnect with curved, flat, or uneven surfaces. To this end, the upper jaw and lower jaw may include a curved or triangular profile to accommodate a round or cylindrical surface as provided by a bar or pole, for example. A soft or compliant pad associated with the upper jaw or the lower jaw may be provided that helps protect the surface to which the clamp is interconnected, to provide additional fictional interaction between the jaws and the surface, as well as allow compression in the system to aid in generating the clamping forces needed.

In operation of one embodiment, the upper jaw of the clamp is engaged onto the surface, such as a tabletop. The lower jaw is then moved to operatively engage the lower surface of the table. Movement of the lower jaw along the rack will also move the spring-biased pawl along the rack teeth. The shape of the teeth and the shape of the pawl allow the pawl to move upwardly along the rail with the teeth moving the pawl over successive teeth. The spring associated with the pawl forces the pawl to return to and indent provided between each tooth. The lower jaw is prevented from moving away from the upper jaw by the pawl's interaction with the rack teeth. The carrier is also associated with a crank which employs a cog that also selectively engages the rack. More specifically, actuation of the crank engages the cog into space between another set of rack teeth. Successive motion of the crank engages the cog onto the rail and causes the pawl to move one or more teeth. When the crank returns to its undeflected position by way of a spring, the pawl is firmly engaged onto the rack and is prevented from sliding. Successive crank motion will cause the carrier to move along the rack towards the upper jaw to tighten the jaws. A pawl release is depressed to remove the pawl from the rack, which allows the lower jaw to be separated from the upper jaw. The unique shape of the cog and its relation to the rack and crank allow for an interaction that allows the cog to reset with every crank pull and avoid contact with the rack inner teeth and associated jamming. The cog, which has three teeth in some embodiments, is curved relative to at least three planes, and yet moldable.

It is yet another aspect of the present invention to provide a clamp that can be folded for storage and transport. More specifically, some embodiments of the present invention provide an upper jaw that is hingedly interconnected to the rack and a lower jaw that is hingedly interconnected to the carrier. After the upper jaw is moved away from the lower jaw, the upper jaw and lower jaw are rotated inwardly towards the rack inner surface to configure the clamp for storage.

One of skill in the art will appreciate that the clamp described may be selectively scaled in size to suit the needs of the application to which is it is intended. Further, the clamp may be made of metal, plastic, a combination of plastic and metal, or any other suitable material.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
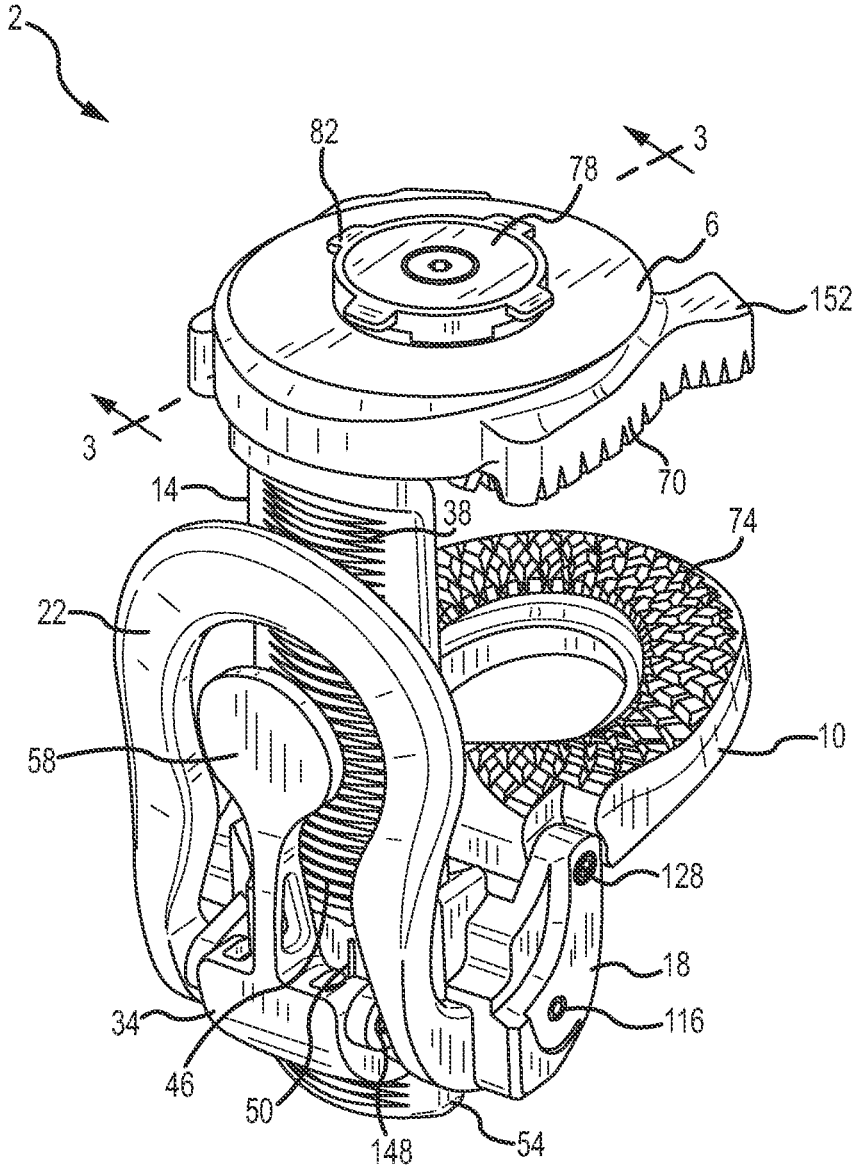
FIG. 1 is a perspective view of the a clamp of one embodiment of the present invention in an open configuration.

To assist understanding of an embodiment of the present invention, the following list of components and associated numbering found in the drawings is provided herein:

| # | Component |
|---|---|
| 2 | Clamp |
| 6 | Upper jaw |
| 10 | Lower jaw |
| 14 | Rack |
| 18 | Carrier |
| 22 | Crank |
| 26 | Cog |
| 28 | Cog teeth |
| 30 | Inside surface |
| 34 | Pawl |
| 38 | Outside surface |
| 42 | Pawl end |
| 46 | Pawl Teeth |

-continued

| # | Component |
|---|---|
| 50 | Pawl spring |
| 54 | Stop |
| 58 | Pawl release |
| 62 | Inner teeth |
| 66 | Spring |
| 70 | Elastomeric member |
| 74 | Elastomeric member |
| 78 | Connector |
| 82 | Keys |
| 86 | Table |
| 100 | Collar |
| 104 | Flexible member |
| 108 | Suction dock |
| 112 | Electronic device |
| 116 | Crank pin |
| 120 | Cog pin |
| 124 | Crank spring |
| 128 | Lower jaw pin |
| 132 | Cap |
| 136 | Upper jaw pin |
| 140 | Retaining screw |
| 144 | Washer |
| 148 | Pawl pin |
| 152 | Fingers |
| 156 | Track |
| 200 | Clamp |
| 206 | Upper jaw |
| 210 | Lower jaw |
| 212 | Upper arm |
| 216 | Lower arm |
| 220 | Extension |

It should be understood that the drawings are not necessarily to scale. In certain Instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-4, a clamp 2 of one embodiment of the present invention is shown that includes an upper jaw 6 and a lower jaw 10. The upper jaw 6 is interconnected to a rack 14. The lower jaw 10 is connected to a carrier 18 that is operatively engaged to the rack 14. The carrier 18 also rotatably supports a crank 22 that includes a cog 26 selectively and operatively interconnected to the inside surface 30 of the rack. The carrier 18 further employs a pawl 34 and that is operatively interconnected to an outside surface 38 of the rack 14. In some embodiments of the present invention, the upper jaw 6 is rotatably interconnected to the rack 14 and the lower jaw 10 is rotatably interconnected to the carrier 18, which will be described in further detail below.

Figure 3:
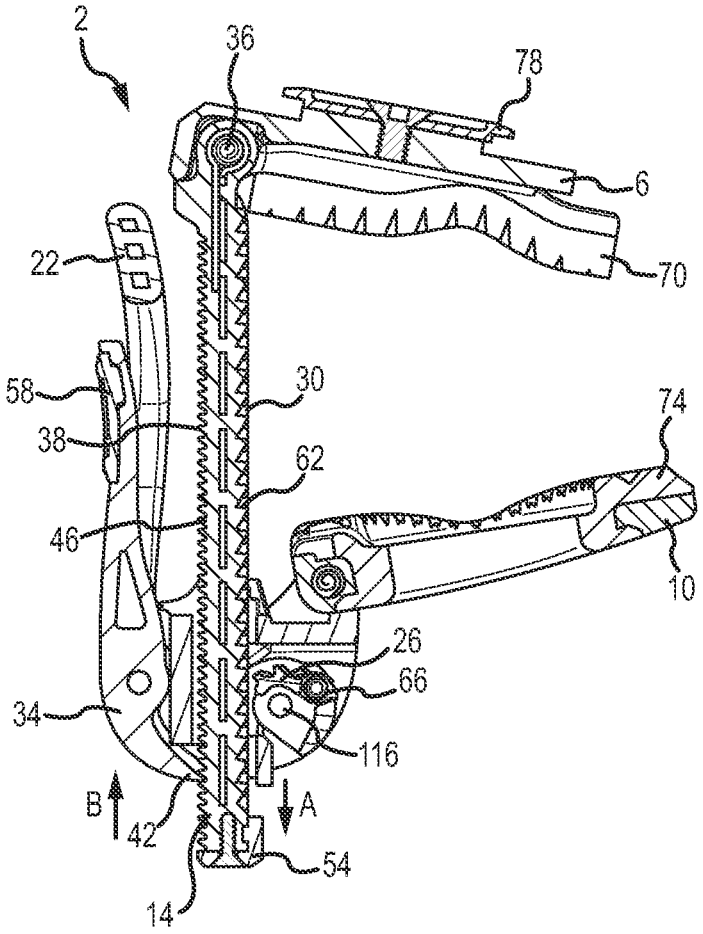
FIG. 3 is a cross-sectional view of FIG. 1.
Figure 3A:
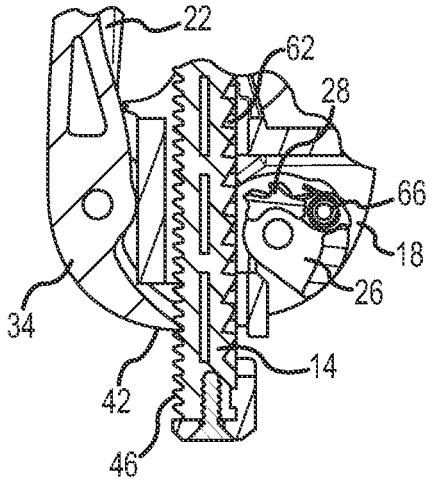
FIG. 3A is a detailed view of FIG. 3 showing the position of components when a crank is in the home position.

Referring specifically now to FIG. 3, the pawl 34 has an end 42 that selectively engages a space between adjacent teeth 46 of the outer surface 38 of the rack 14. The teeth 46 are shaped to allow movement of the pawl 34 in one direction and to prevent movement of the pawl 34 in an opposite direction. Thus, the interaction of the pawl 34 and the teeth 46 maintain the distance between the upper jaw 6 and the lower jaw 10 such that the carrier 18 cannot be moved along direction A when the pawl 34 is engaged. However, pressure from below the carrier 18 or below the lower jaw 10 along direction B will move the lower jaw 10 towards the upper jaw 6. The pawl 34 is biased by a spring 50 wherein pressure along direction B will selectively move the end 42 along the rack 14 incrementally over successive teeth 46 falling into the spaces between adjacent teeth in a ratcheting manner as it moves. The carrier 18 is prevented from sliding from the rack 14 by a stop 54 at the end of the rack 14. To expand the lower jaw 10 from the upper jaw 6, a pawl release 58 is actuated, which moves the end 42 of the pawl 34 from the rack 14, allowing the carrier 18 to move along the rack 14.

The carrier 18 also accommodates a crank 22 that includes a cog 26 that operatively engages teeth 62 on the inside surface 30 of the rack 14. The crank 22 is rotated away from the rack 14 along arc C (see pg 4), which engages the cog 26 onto the teeth 62 to incrementally urge the lower jaw 10 towards the upper jaw 6. The cog 26 is also biased by a spring 66 such that when pressure is removed from the crank 22, it will return to a relaxed position away from the rack 14. In the relaxed position, the cog 26 is separated from the teeth 62 wherein only the pawl 34 holds the carrier 18 in place. Interaction between the cog 26 and the crank helps move the crank to a position adjacent the rack when pressure is released.

Figure 3B:
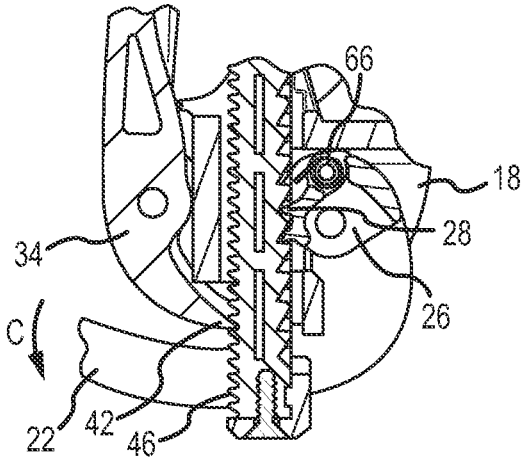
FIG. 3B is a detailed view of FIG. 3 showing the engagement of cog teeth with the rack teeth as the crank is moved.
Figure 3C:
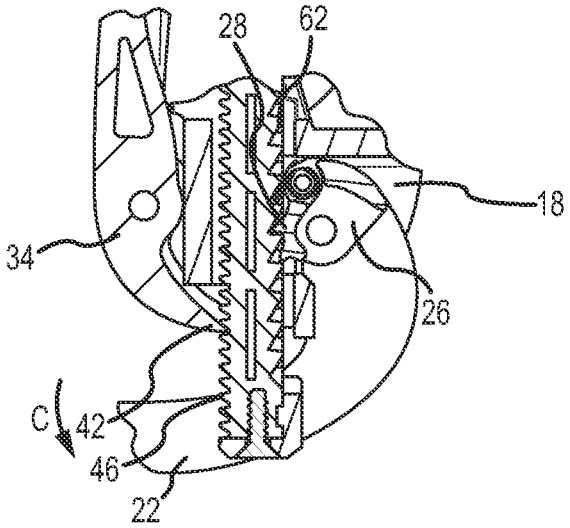
FIG. 3C is a detailed view of FIG. 3 showing the position of the components at the end of the range of travel of the crank.
Figure 3D:
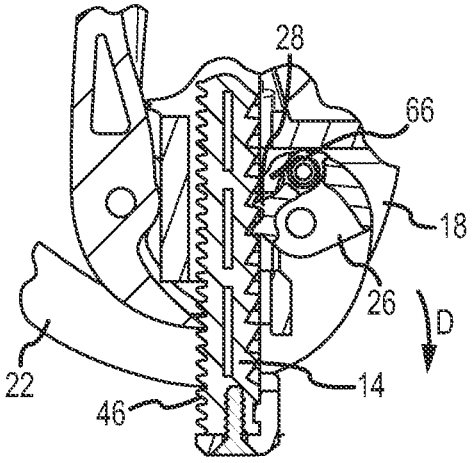
FIG. 3D is a detailed view of FIG. 3 showing the position of the cog as the crank moves back towards the home position.
Figure 4:
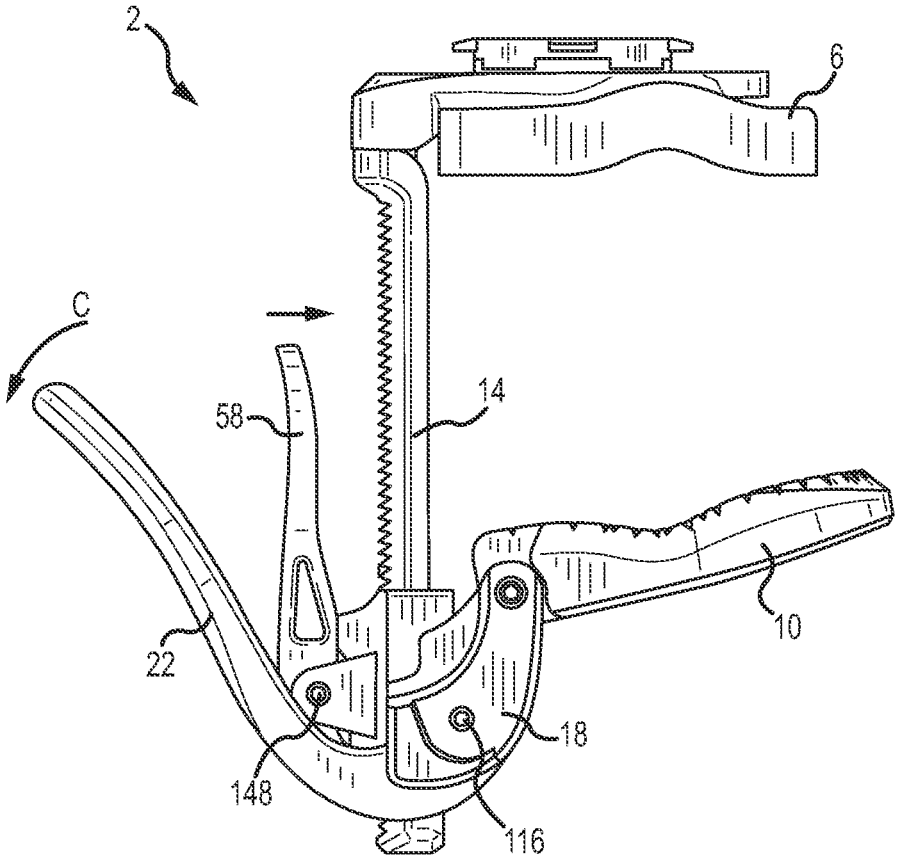
FIG. 4 is a side elevation view of FIG. 1 showing the crank moved which actuates the cog that urges a lower jaw closer to an upper jaw.

FIGS. 3A-3D illustrate the operation of the cog 26 of one embodiment of the present invention. When the crank 22 is in a neutral, non-deflected position (FIG. 3A), the cog 26 and its teeth 28 are not engaged onto the inner teeth 62 of the rack 14. Movement of the crank 22 along arc C will rotate the cog teeth 28 into engagement with the rack inner teeth 62 (FIG. 3B). The cog teeth 28 will then engage the rack inner teeth 62 and urge the carrier 18 upwardly along direction B as shown in FIG. 3. As the carrier is moved upwardly, the pawl end 42 will transition over a tooth 46. Further movement of the crank 22, as shown in FIG. 3C, will completely engage the cog teeth 28 onto the inner rack teeth 62, which incrementally moves the carrier 18. After the pawl end clears the outer tooth 46, the pawl spring will bias the pawl end 42 into engagement with the rack between adjacent teeth 46. Release of the crank 22 (FIG. 3D) allows the cog 26 to rotate back to a neutral position along arc D, such rotation being facilitated by a cog spring 66. After the crank 22 returns to its neutral, non-deflected position, the pawl end 42 maintains the position of the carrier 18.

In some embodiments of the present invention, the upper jaw 6 and the lower jaw 10 include elastomeric members 70, 74 that allow them to engage surface without damaging the same. Elastomeric members 70, 74 also increase the friction between the jaws and the surface to which the clamp is interconnected which enhances the connection.

As mentioned above, the clamp 2 may also include a connector 78. The connector 78 may include four keys 82 that received a supporting device with a corresponding bayonet fitting.

Figure 5:
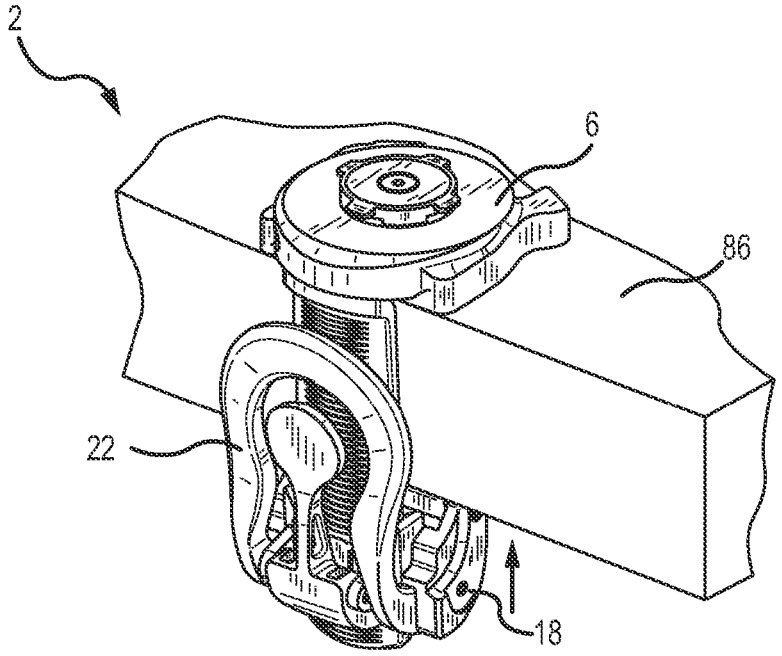
FIG. 5 is a perspective view showing the clamp interconnected to a horizontal surface.
Figure 6:
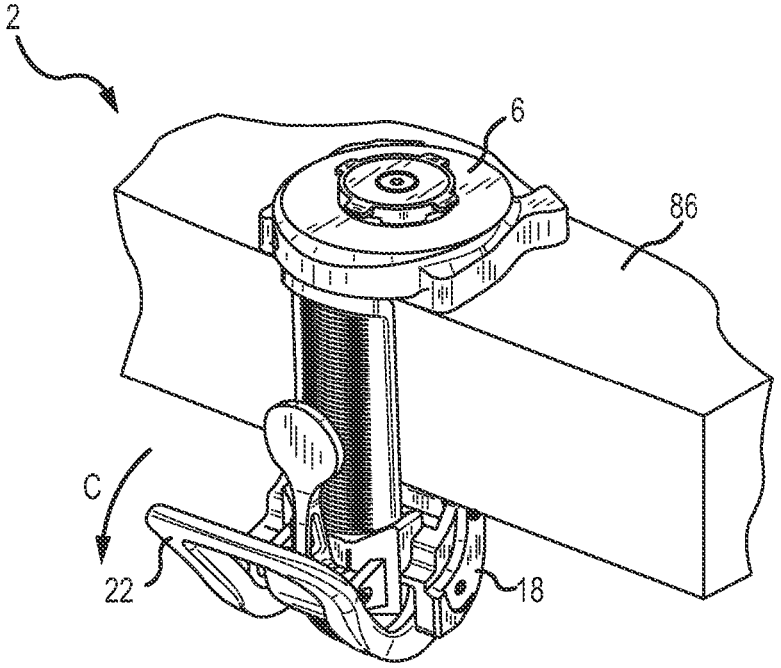
FIG. 6 is a perspective view similar to FIG. 6 showing the crank moved outwardly to further bias the lower jaw against a horizontal surface.

FIGS. 5 and 6 show the clamp 2 of one embodiment of the present invention interconnected to a horizontal surface 86, such as a table. Initially, the upper jaw 6 is placed on an upper surface of the table. Next, the carrier 18 is slid upwardly and the lower jaw (not shown) is engaged to the lower surface of the table 86. Alternatively, the crank 22 may be used to incrementally move the lower jaw towards the lower surface of the table 86. When the lower jaw is engaged to the lower surface of the table, the clamp may still be somewhat loose. If so, the crank 22 is rotated outwardly along direction C (see FIG. 2) to incrementally move the lower jaw into a tight engagement with the lower surface of the table. The clamp force is also reacted by the upper jaw 6 engaged to the upper surface of the table.

Figure 7:
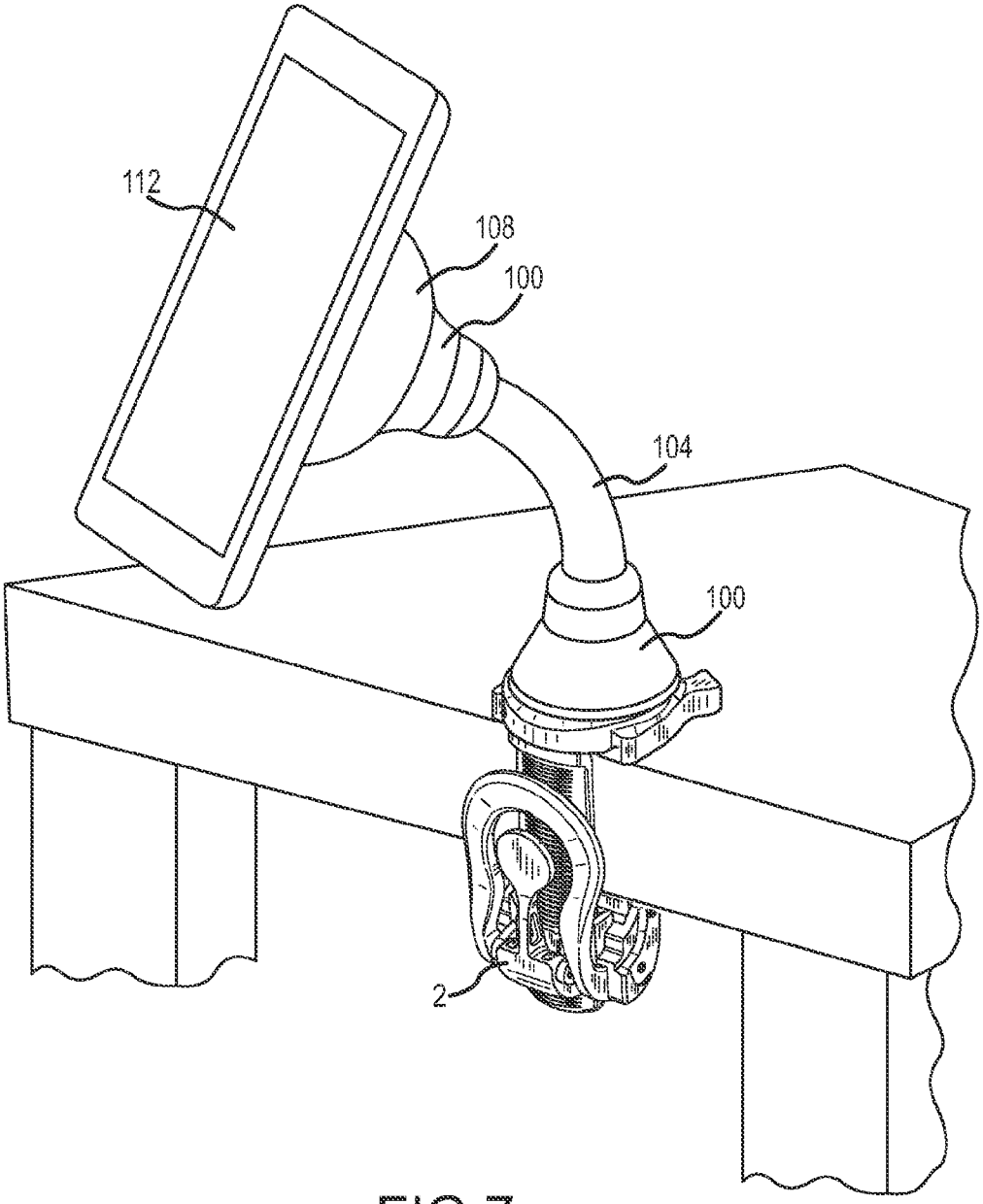
FIG. 7 is a perspective view showing the clamp interconnected to a table and interconnected to devices, supports, and mechanisms adapted to secure an electronic device.

FIG. 7 shows how the crank 20 receives and supports additional items. Here, a collar 100 and flexible member 104 are interconnected to the clamp 2. The claim 2 may have a bayonet style interconnection device or any other connection mechanism known in the art to receive and secure a corresponding connection mechanism of the desired support or mounts. The flexible member 104 is interconnected to another collar 100 and a suctioning dock 108 that secures an electronic device 112. Although, flexible positioning members and suctioning mounts are shown, those of skill in the art will appreciate that other selectively adjustable or static supporting systems may be interconnected to the clamp without departing from the scope of the present invention.

Figure 2:
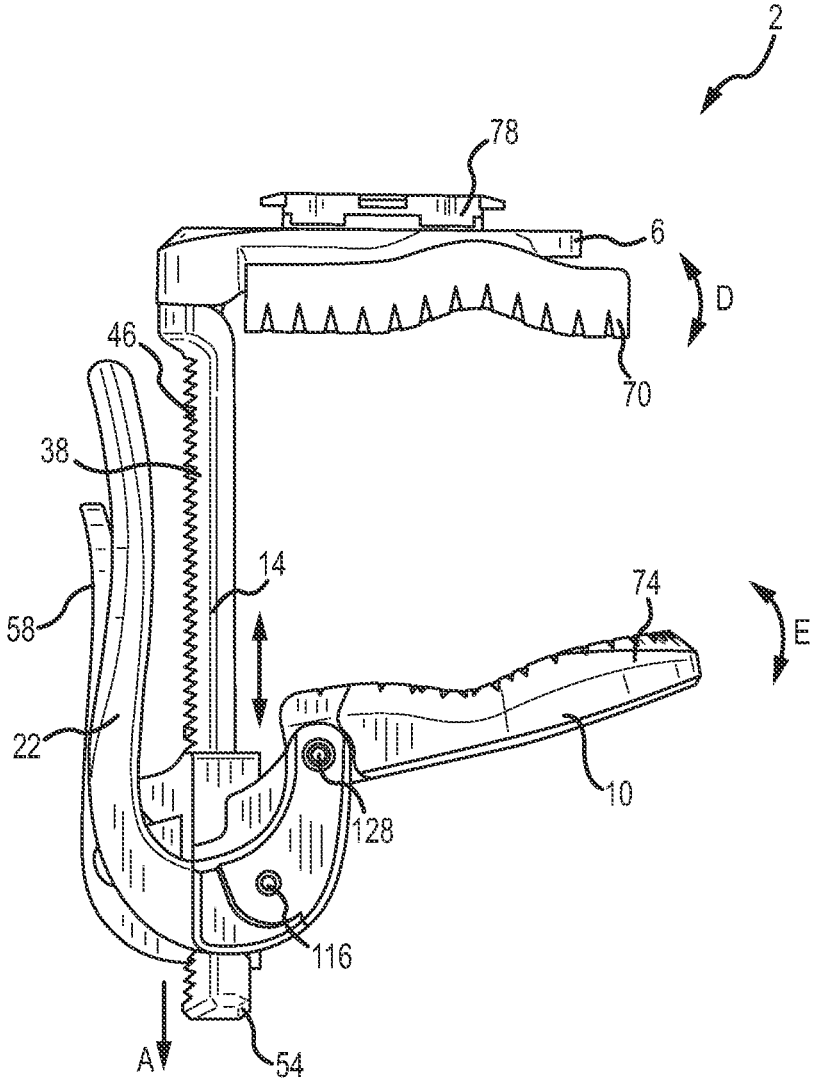
FIG. 2 is a side elevation view of FIG. 1.
Figure 8:
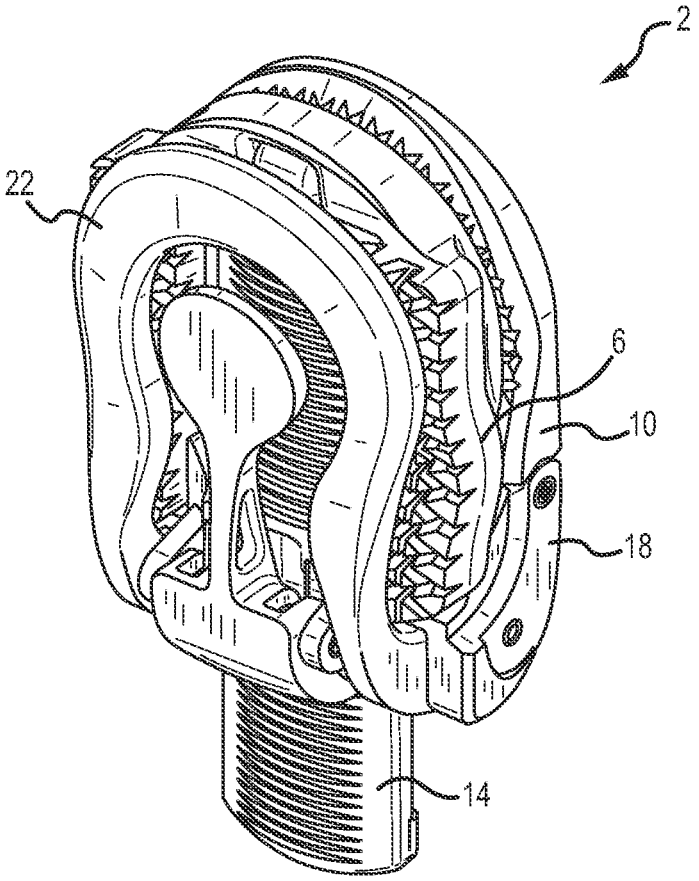
FIG. 8 is a perspective view showing the clamp of FIG. 1 in a folded position of use.
Figure 9:
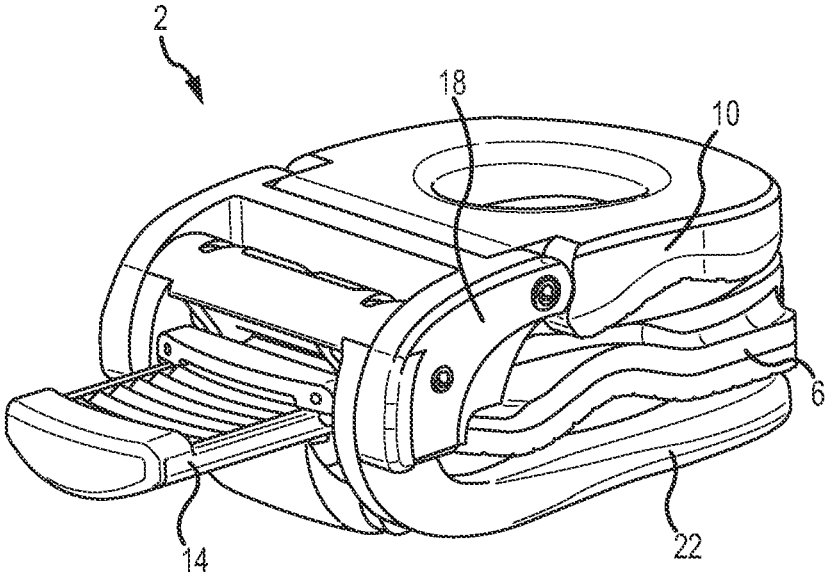
FIG. 9 is another perspective view showing the clamp of FIG. 1 in a folded position of use.

FIGS. 2, 8, and 9 illustrate how embodiments of the present invention are folded. More specifically, the upper jaw 6 is rotatably interconnected to the rail 14 and may be selectively rotated along an arc D. The lower jaw 10 is rotatably is rotatable along arc E. In this way, the clamp 2 can assume a low profile storage configuration.

Figure 10:
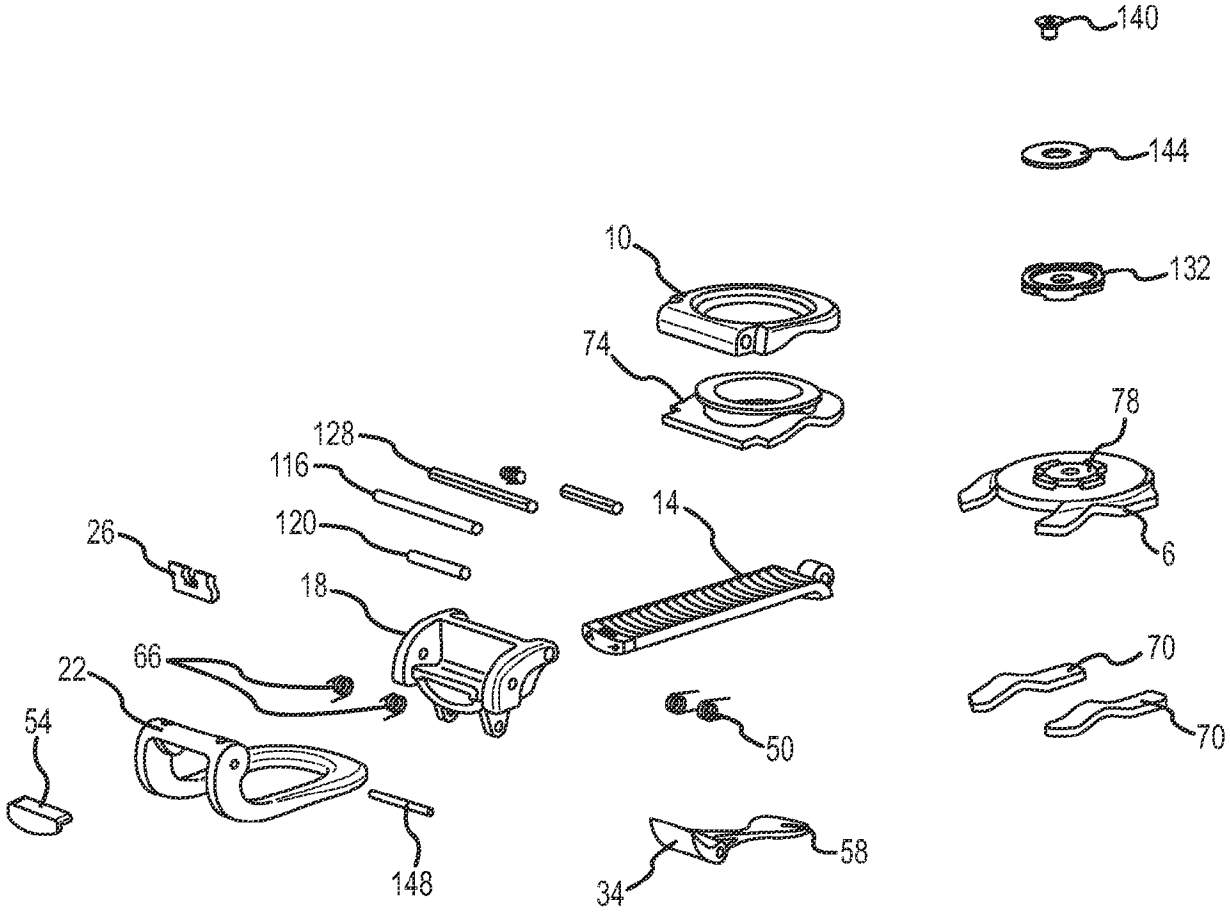
FIG. 10 is an exploded view of FIG. 1.
Figure 11:
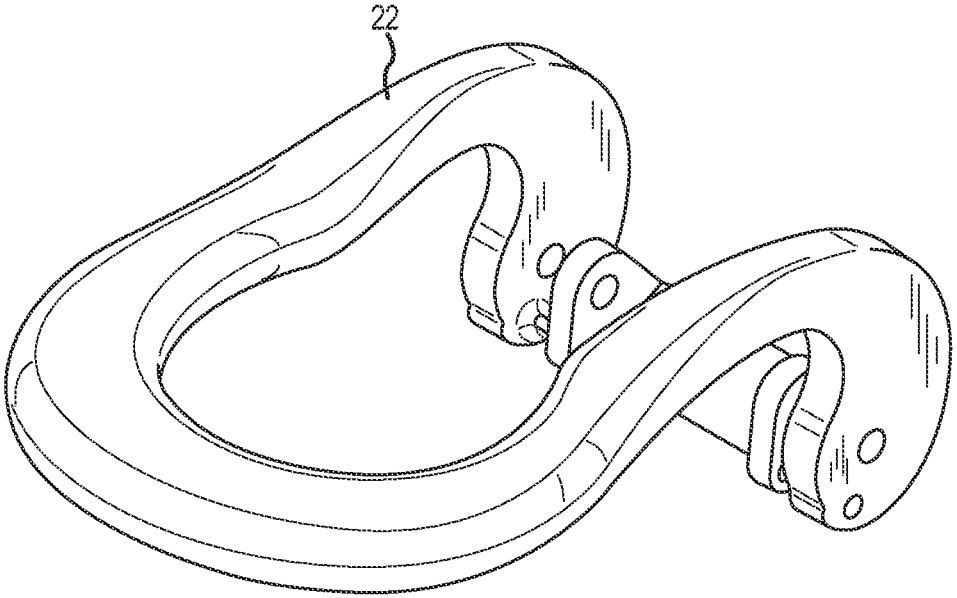
FIG. 11 shows a crank of one embodiment of the present invention.

FIG. 10 is an exploded view of the clamp and FIGS. 11-18 are representations of the components in FIG. 10. FIG. 11 shows a crank 22 is a U-shaped injection molded part made of about 30% long-fiber glass filled nylon. Receiving holes are provided for pins that allow the crank 22 to interface with other components. The other end of the crank 22 is covered by a polyurethane rubber over-molded grip. The crank 22 serves as the force input to the folding clamp. When the user applies a force to the u-shaped end of the crank 22, it rotates about a crank pin 116 forcing the cog 26 to mesh with the corresponding teeth on the rack 16. The force transmitted through the cog 26 pushes the lower jaw 10 towards the upper jaw 6. The crank 22 interfaces with the carrier 18 via a crank pin 116. The crank 22 also interfaces with the cog 26 via the cog pin 120 and a cog spring that returns the cog 26 to a relaxed position.

Figure 12B:
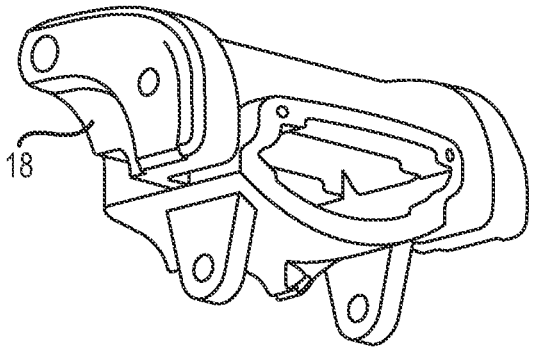
FIG. 12B shows another view of the carrier of FIG. 12A.
Figure 12A:
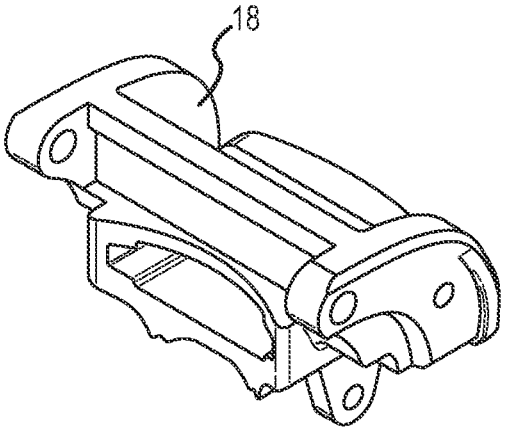
FIG. 12A shows a carrier of one embodiment of the present invention.

FIGS. 12A and 12B show the carrier 18 which may be an injection molded part made of about 30% glass filled nylon. It is geometrically complex with three sets of mounting holes and a large channel in the center. The carrier 18 holds the crank 22, pawl 34, and lower jaw 10 in the correct position relative to each other. Additionally, the carrier 18 slides along the rack 16 in response to force input through the crank 22, for example, which allows the clamp jaws to be pushed together.

Figure 13:
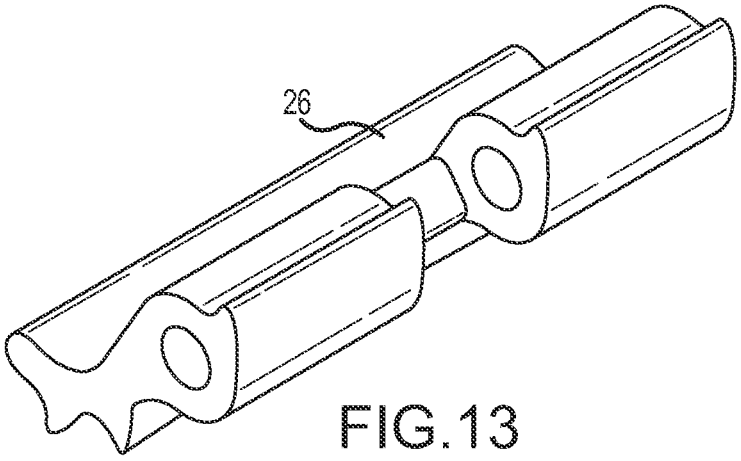
FIG. 13 shows a drive cog of one embodiment of the present invention.

FIG. 13 shows the cog 26 of one embodiment that is a small aluminum die cast piece with curved gear teeth along the bottom side and a lateral mounting hole. The cog may also be injection molded in glass-filled (GF) Nylon. The cog 26 transmits the input force of one end of the crank 22 onto the rack 14 forcing the carrier 18 to push the lower jaw 10 towards the upper jaw 6. As the crank 22 is rotated away from its home position, the curved teeth on the lower side of the drive cog 26 mesh with corresponding teeth on the rack 14. With the teeth meshed, further motion of the crank 22 moves the carrier 18 along the rack 14 and moves the lower jaw 10 towards the upper jaw 6. As the crank 22 rotates from the fully extended position toward its home position, the cog 26 rotates so its teeth rotate past the teeth on the rack 14. Repeated motion of this incrementally moves the pads together.

Figure 14:
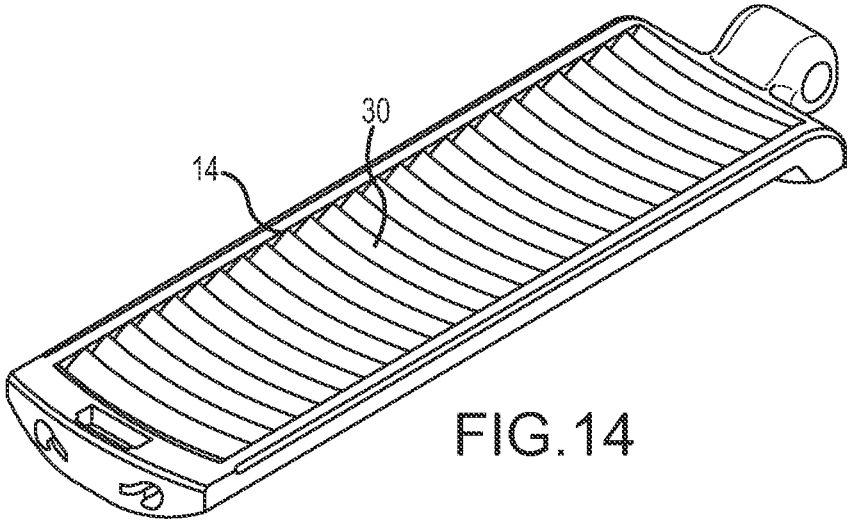
FIG. 14 shows a rack of one embodiment of the present invention.

FIG. 14 shows the rack 14 of one embodiment made of 30% glass filled nylon piece overmolded onto a stamped steel insert. In some embodiments of the present invention, the rack 14 is stiff but flexible such the rack 14 will bow when the upper jaw and the lower jaw are firmly engaged onto a surface. The bowed rack will tend to recoil, i.e. attempt to return to its non-deflected state, which further biases the top jaw towards the bottom jaw to increase clamping force. The rack 14 has a generally rectangular profile with gear teeth on either side. Both of the sets of gear teeth may have a curved profile. Curved teeth allow for a larger surface area and disbursement of forces that allows for a stronger structure in a reduced envelope. The top of the rack 14 has a boss with a hole for a mounting pin. The bottom of the rack 14 has two longitudinal blind holes. The stamped steel insert protrudes out of the rack 14 on one of the large faces near the rack bottom. The rack 14 provides the running surface that allows the two jaws of the clamp to move together. As the carrier 18 slides along the rack 14, the lower jaw 10 moves relative to the upper jaw 6. Additionally, the rack 14 has teeth that allow the ratcheting action that creates and maintains force between the lower jaw 10 and the upper jaw 6.

Figure 15:
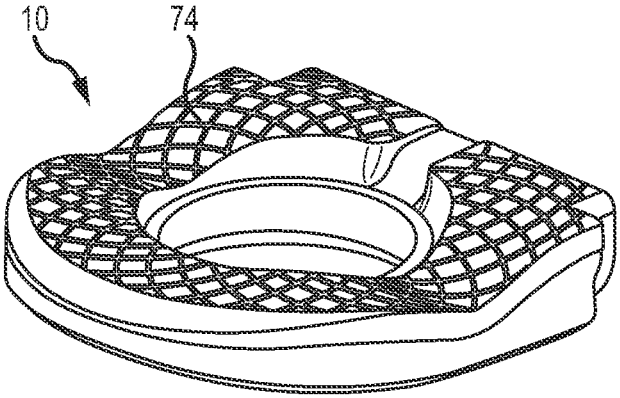
FIG. 15 shows a lower jaw assembly of one embodiment of the present invention.

FIG. 15 shows the lower jaw assembly of one embodiment that comprises an injection molded lower jaw 10 with an overmolded elastomeric lower pad 74 on one side. The lower jaw 10 is made of 30% glass filled nylon and the overmolding 74 is polyurethane rubber. The lower jaw assembly has a large (about 25 mm) hole in its center and a pin hole running laterally through one end.

Figure 16:
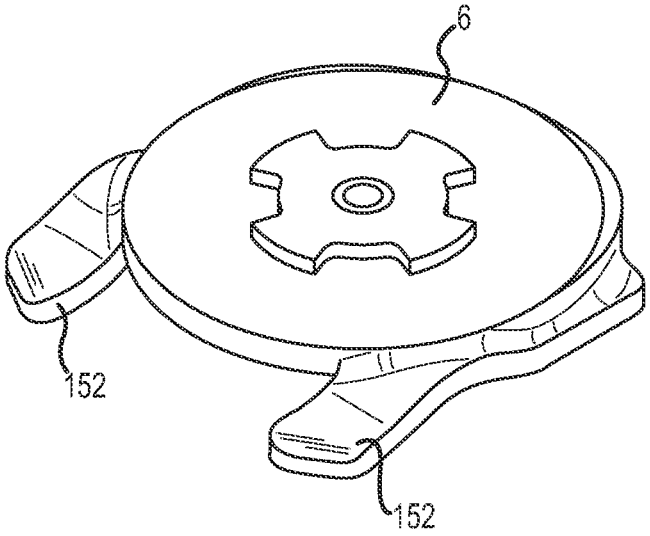
FIG. 16 shows an upper jaw of one embodiment of the present invention.
Figure 17:
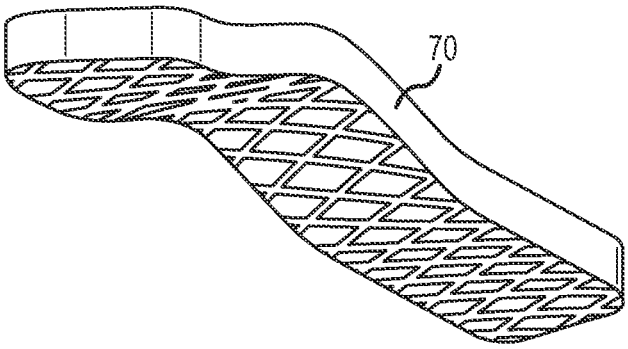
FIG. 17 shows an upper pad of one embodiment of the present invention.

Referring to FIGS. 16 and 17, the upper jaw 6 is a generally round part made of 30% glass filled nylon that is overmolded onto an M6 threaded brass insert. The upper jaw 6 has a laterally oriented hole for a mounting pin. There are two features, i.e., fingers 152, on the bottom side of the upper jaw 40 that provide a clamping face. The primary functions of the upper jaw 6 provide a clamping surface opposite the lower jaw assembly and to provide a mounting surface for attachment to external elements, such as those shown in FIG. 7. One side of the upper jaw 6 has two 10 mm wide fingers 152 with a flat face on either side of a cylindrical face, allowing them to clamp both flat and round objects. Each finger 152 receives an elastomeric member 70. The elastomeric members 70 are polyurethane rubber pieces with a 60A durometer. As the two jaws of the clamp move together the elastomeric members compress providing feedback to the user about the level of force applied. Once the clamp is in position over an object, such as the table, the elastomeric material of the elastomeric members maintain their compression, which helps maintain a clamping force. The elastomeric members also have a tread pattern for increased grip on rough surfaces.

Figure 18:
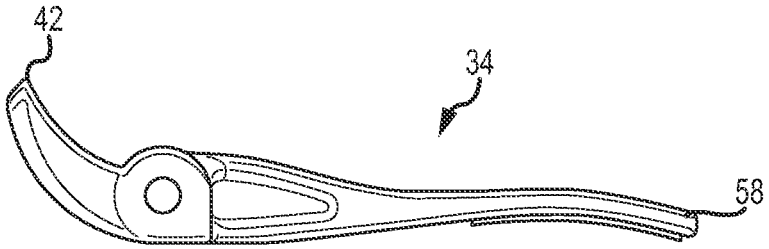
FIG. 18 shows a pawl of one embodiment of the present invention.

Referring to FIG. 18, the pawl 34 is an injection molded part made from 30% glass filled nylon. It has a lateral pin hole with a lever on one side and a gear tooth on the other. There may be a round feature at the end of the lever on the pawl 34 that acts as a button. There are also two small cuts on the underside of the pawl 58 to allow for pawl springs. The pawl 34 contributes to the ratcheting action of the clamp by preventing motion of the carrier that would allow the jaws to spread apart. The geometry of the pawl end 42 and the corresponding teeth on the rack allow the pawl 34 to be dragged over teeth on the rack when the jaws are moving closer, but prevents the jaws from spreading apart. When the button on the pawl 34 is depressed, the pawl end 42 rotates away from the rack and the jaws may open.

Figure 19:
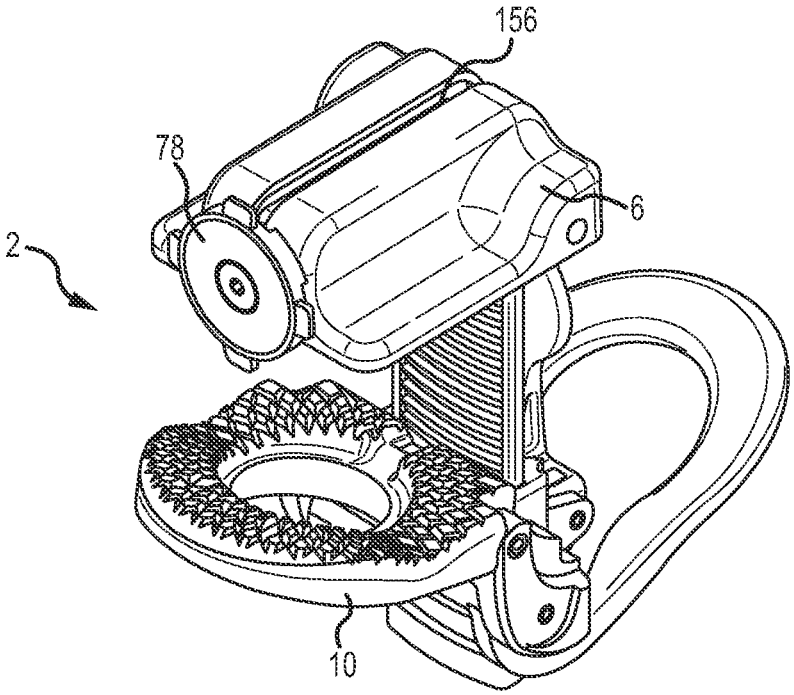
FIG. 19 is a perspective view of another embodiment of the present invention showing a movable connector in a first position of use.
Figure 20:
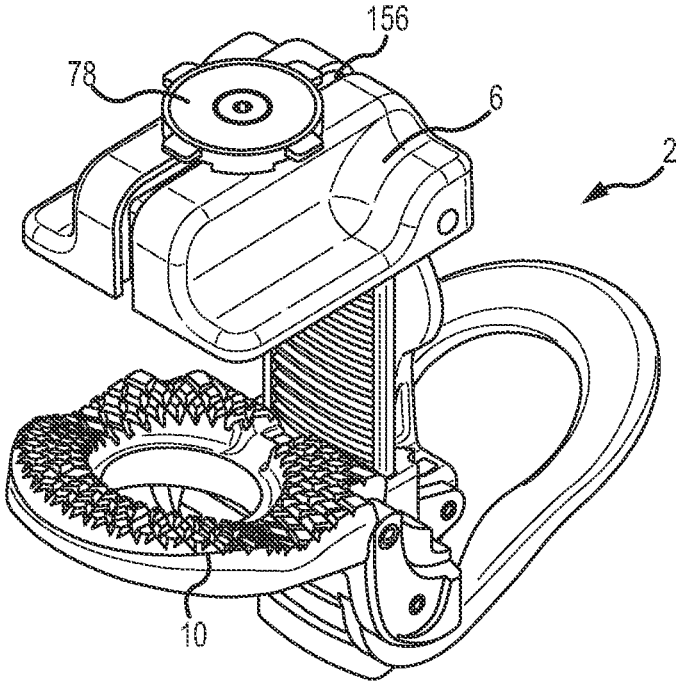
FIG. 20 is a perspective view of another embodiment of the present invention showing a movable connector in a second position of use.
Figure 21:
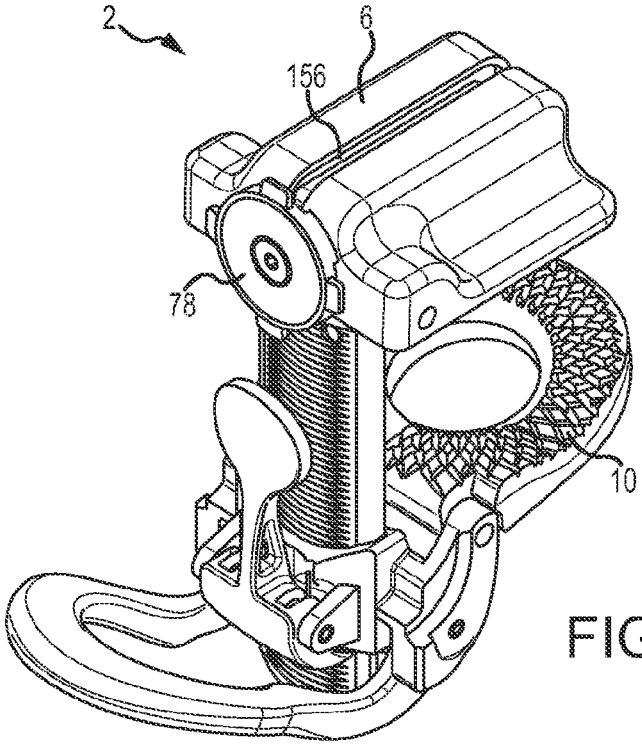
FIG. 21 is a perspective view of another embodiment of the present invention showing a movable connector in a third position of use.
Figure 22:
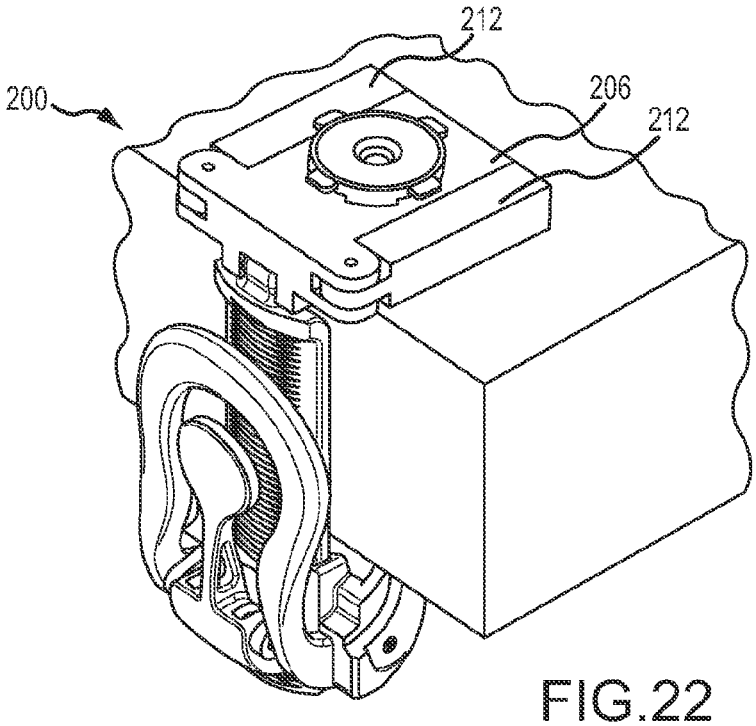
FIG. 22 is a top perspective view of another embodiment of the present invention that employs selectively foldable and deployable arms.
Figure 23:
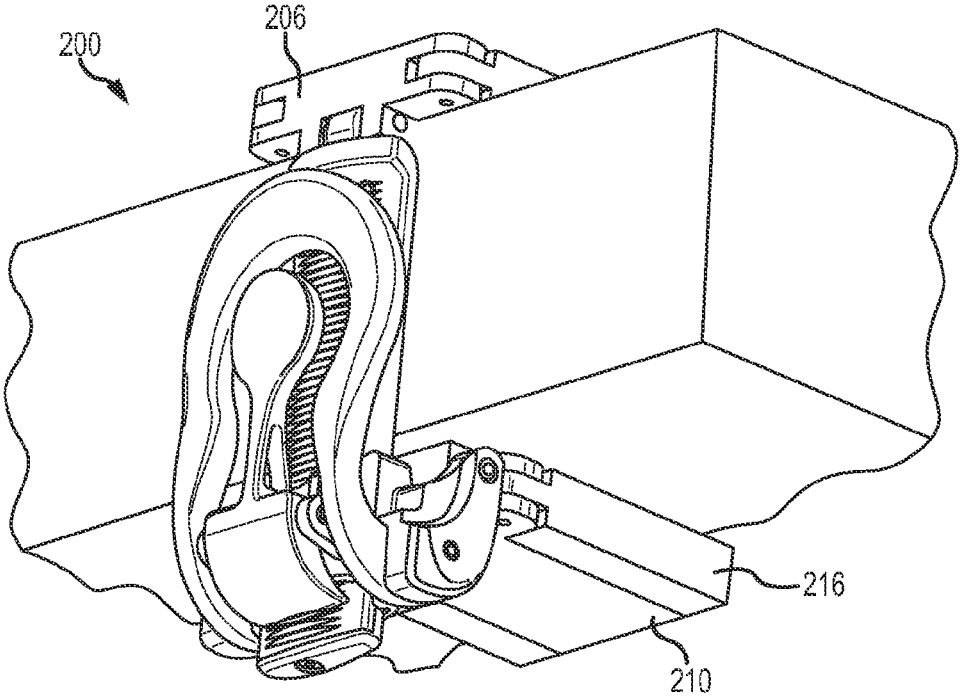
FIG. 23 is a bottom perspective view of another embodiment of the present invention that employs selectively foldable and deployable arms.
Figure 24:
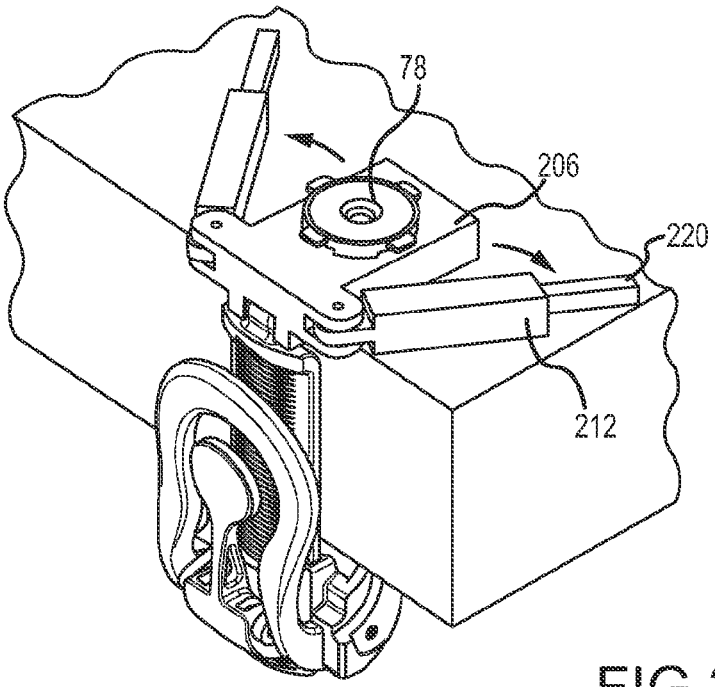
FIG. 24 is a top perspective view of the embodiment shown FIG. 22, wherein upper arms are angled and extended.
Figure 25:
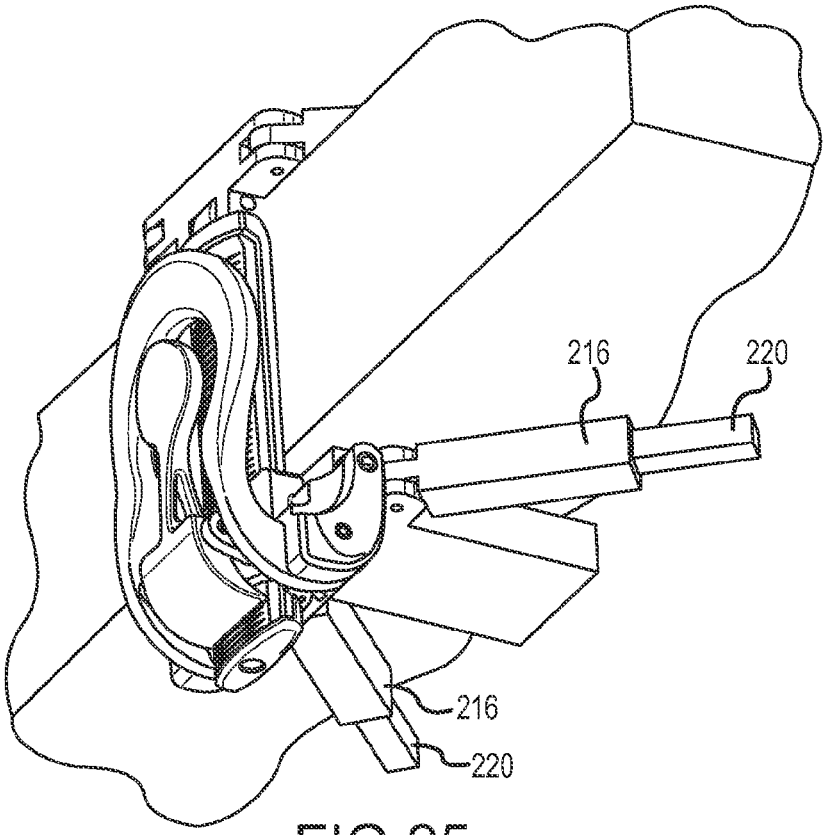
FIG. 25 is a bottom perspective view of the embodiment shown FIG. 22, wherein lower arms are angled and extended.
Figure 26:
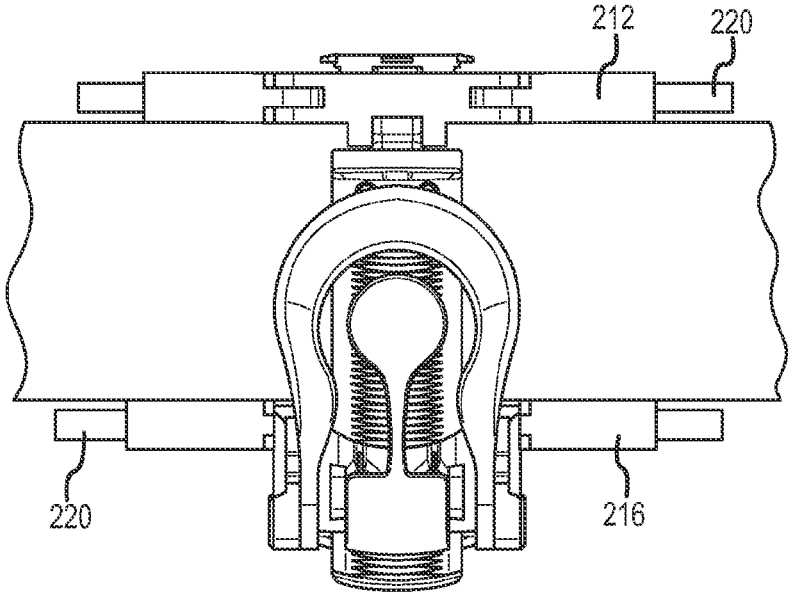
FIG. 26 is a front elevation view of the embodiment shown in FIG. 22, wherein the upper arms and lower arms are angled and extended.

FIGS. 19-21 show a clamp 2 of another embodiment of the present invention that includes an upper jaw 6 that provides the ability to change location of the connector 78. More specifically, the upper jaw 6 includes a track 156 that operatively receives the connector 78. The connector 78 can be placed at or near the outward extent of the upper jaw (FIG. 19), on the upper surface of the upper jaw 6 (FIG. 20), at or near the inward extent of the upper jaw 6 (FIG. 21), or various positions therebetween. This embodiment thus provides the user a multitude of connector 78 orientation options which further enhances their ability to position an electronic device, for example. Once in a desired position, the connector 78 is will locked in place. Further, one of skill in the art will appreciate that the track 156 may be positioned transverse to, or at an angle relative to, the track shown and that a plurality of tracks may be provided without departing from the scope of the invention.

FIGS. 22-26 shows a clamp 200 of yet another embodiment of the present invention that employs deployable arms. More specifically, the upper jaw 206 and/or the lower jaw 210 may include arms 212, 216 that flair out from their respective jaws to increase the contact footprint of the jaws onto a surface. Here, the arms 212 of the upper jaw 26 are angled outwardly, which helps react transverse clamp loads emanating from the connector 78, for example. Similarly, the arms 2 and 16 of the lower jaw 210 react transverse loads and increase the load footprint, which helps react longitudinal loads emanating from the connector 78. In this example, "longitudinal" refers to the direction perpendicular to the upper surface of the upper jaw 206 and generally parallel to a side surface of the clamp 200, and "transverse" refers to a direction orthogonal to the longitudinal direction. Although shown angled symmetrically, one of skill in the art will appreciate the arms 212, 216 may be independently rotated. Further, some embodiments of the present invention include extensions 220 that operatively increase arm length and thus influence the contact influence and stability of the clamp 200.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A clamp, comprising:

a rack having a plurality of spaced outer teeth and a plurality of spaced inner teeth;

an upper jaw interconnected to said rack;

a carrier operatively interconnected to said rack;

a lower jaw interconnected to said carrier and spaced from said upper jaw;

a spring-biased pawl rotatably interconnected to said carrier, said pawl having a first portion rotatably interconnected to said carrier and a second portion that is adapted to selectively engage a space between adjacent teeth of said plurality of spaced outer teeth;

a pawl release associated with said spring-biased pawl, actuation of said pawl release removes said second portion from said plurality of spaced outer teeth; and a spring-biased crank rotatably interconnected to said carrier and positioned on a side of said rack opposite said upper jaw and said lower jaw, said crank having an end that that is adapted to selectively engage a space between adjacent teeth of said plurality of spaced inner teeth, said crank being spring-biased such that release of said crank removes said second portion from said plurality of spaced inner teeth, wherein rotation of said crank moves said lower jaw incrementally towards said upper jaw while said end of said crank remains in contact with said plurality of spaced inner teeth, and wherein the distance between said upper jaw and said lower jaw is maintained by said spring-biased pawl that is moved along said outer teeth in a direction towards said upper jaw when said crank is rotated.

2. The clamp of claim 1, wherein said upper jaw has a lower surface and is rotatably interconnected to said rack, said upper jaw having a first position of use wherein said lower surface is generally perpendicular to said rack, and said lower jaw has an upper surface and is rotatably interconnected to said carrier, said lower jaw having a first position of use wherein said upper surface is generally perpendicular to said rack, wherein said upper jaw has a second, folded position of use, wherein said lower surface is positioned adjacent to said rack and said lower surface is generally parallel to said rack; and wherein said lower jaw has a second, folded position of use, wherein said upper surface is positioned adjacent to said rack and said upper surface is generally parallel to said rack.

3. The clamp of claim 2, wherein in said second, folded position of use the upper jaw is positioned between said rack and said lower jaw.

4. The clamp of claim 1, further comprising a pad interconnected to said upper jaw on a surface facing said lower jaw, and a pad interconnected to said lower jaw on a surface facing said upper jaw.

5. The clamp of claim 1, wherein at least one of said upper jaw and said lower jaw include a laterally disposed arcuate profile.

6. The clamp of claim 1, wherein said lower jaw has an outermost portion that extends further from said rack than an outermost portion of said upper jaw.

7. The clamp of claim 1, further comprising a connector interconnected to an upper surface of said upper jaw.

8. The clamp of claim 1, wherein said inner teeth are curved, such that the outermost surface thereof is not linear.

9. The clamp of claim 1, wherein said pawl and said crank are positioned on one side of said rack and said upper jaw and said lower jaw are generally positioned on the opposite side of said rack.

10. A clamp, comprising:

a ratchet rack;

an upper jaw interconnected to said rack;

a carrier operatively interconnected to said rack;

a lower jaw interconnected to said carrier and spaced from said rack;

a pawl rotatably interconnected to said carrier, said pawl having an end that selectively engages said rack in a ratcheting manner;

a pawl release associated with said pawl, actuation of said pawl release removes said pawl from said rack;

a crank rotatably interconnected to said carrier and positioned on a side of said rack opposite said upper jaw and said lower jaw, said crank associated with a cog adapted to selectively engage said ratchet rack to move said lower jaw incrementally towards said upper jaw; and wherein rotation of said crank moves said lower jaw incrementally towards said upper jaw while said cog remains in contact with said ratchet rack.

11. The clamp of claim 10 wherein said ratchet rack has a plurality of spaced outer teeth that selectively receive said end of said pawl, and a plurality of spaced inner teeth that selectively receive said cog; and wherein said outer teeth and said inner teeth having different configurations.

12. The clamp of claim 10, wherein said upper jaw has a lower surface and is rotatably interconnected to said rack, said upper jaw having a first position of use wherein said lower surface is generally perpendicular to said rack, and a lower jaw has an upper surface and is rotatably interconnected to said carrier, said lower jaw having a first position of use wherein said upper surface is generally perpendicular to said rack, wherein said upper jaw has a second, folded position of use, wherein said lower surface is positioned adjacent to said rack and said lower surface is generally parallel to said rack; and wherein said lower jaw has a second, folded position of use, wherein said upper.

13. The clamp of claim 10, further comprising a pad interconnected to said upper jaw on a surface facing said lower jaw, and a pad interconnected to said lower jaw on a surface facing said upper jaw.

14. The clamp of claim 10, wherein at least one of said upper jaw and said lower jaw include a laterally disposed arcuate profile.

15. The clamp of claim 10, wherein said lower jaw has an outermost portion that extends further from said rack than an outermost portion of said upper jaw.

16. The clamp of claim 10, further comprising a connector interconnected to an upper surface of said upper jaw.

17. The clamp of claim 16, wherein said upper jaw includes a track that operatively receives said connector.

18. The clamp of claim 10, wherein at least one of said upper jaw and said lower jaw include selectively deployable fingers.

19. The clamp of claim 10, wherein said rack is resiliently deflectable.

20. The clamp of claim 10, wherein said pawl and said crank are positioned on one side of said rack and said upper jaw and said lower jaw are generally positioned on the opposite side of said ratchet rack.

* * * * *